US008112181B2

(12) United States Patent
Remsburg

(10) Patent No.: US 8,112,181 B2
(45) Date of Patent: Feb. 7, 2012

(54) AUTOMATIC MOLD AND FUNGUS GROWTH INHIBITION SYSTEM AND METHOD

(76) Inventor: Ralph Remsburg, San Diego, CA (US)

( * ) Notice: Subject to any disclaimer, the term of this patent is extended or adjusted under 35 U.S.C. 154(b) by 189 days.

(21) Appl. No.: 12/576,250

(22) Filed: Oct. 9, 2009

(65) Prior Publication Data

US 2010/0305761 A1 Dec. 2, 2010

Related U.S. Application Data

(60) Provisional application No. 61/104,707, filed on Oct. 11, 2008.

(51) Int. Cl.
*G05D 23/00* (2006.01)

(52) U.S. Cl. ..... 700/277; 700/276; 700/278

(58) Field of Classification Search ..... 700/276, 700/277, 278, 299, 300
See application file for complete search history.

(56) References Cited

U.S. PATENT DOCUMENTS

| | | | | |
|---|---|---|---|---|
| 4,339,073 | A | 7/1982 | Staloff | |
| 4,819,714 | A | 4/1989 | Otsuka | |
| 4,997,029 | A | 3/1991 | Otsuka | |
| 5,181,653 | A | 1/1993 | Foster | |
| 5,711,480 | A * | 1/1998 | Zepke et al. | 236/51 |
| 6,536,675 | B1 * | 3/2003 | Pesko et al. | 236/47 |
| 6,731,992 | B1 * | 5/2004 | Ziegler, Jr. | 700/19 |
| 6,996,999 | B2 | 2/2006 | Wacker | |
| 7,130,720 | B2 * | 10/2006 | Fisher | 700/277 |
| 7,156,316 | B2 * | 1/2007 | Kates | 236/1 B |
| 7,163,156 | B2 * | 1/2007 | Kates | 700/277 |
| 7,168,627 | B2 * | 1/2007 | Kates | 700/277 |
| 7,225,054 | B2 | 5/2007 | Amundson | |
| 7,244,390 | B2 * | 7/2007 | Bates et al. | 422/24 |
| 7,264,649 | B1 * | 9/2007 | Johnson et al. | 95/10 |
| 7,334,938 | B2 | 2/2008 | Remsburg | |
| 7,336,168 | B2 * | 2/2008 | Kates | 340/539.18 |
| 7,369,955 | B2 * | 5/2008 | Lee | 702/81 |
| 7,382,269 | B2 | 6/2008 | Remsburg | |
| 7,395,677 | B2 * | 7/2008 | Fujiyoshi et al. | 62/324.1 |
| 7,455,236 | B2 * | 11/2008 | Kates | 236/1 B |
| 7,455,237 | B2 * | 11/2008 | Kates | 236/1 B |
| 7,575,179 | B2 * | 8/2009 | Morrow et al. | 236/91 D |
| 7,606,635 | B2 * | 10/2009 | Fisher | 700/277 |
| 7,809,472 | B1 * | 10/2010 | Silva et al. | 700/277 |
| 7,904,209 | B2 * | 3/2011 | Podgorny et al. | 700/276 |
| 8,020,777 | B2 * | 9/2011 | Kates | 700/276 |
| 8,033,479 | B2 * | 10/2011 | Kates | 236/1 B |
| 2004/0000152 | A1 * | 1/2004 | Fischer | 62/94 |
| 2004/0120846 | A1 * | 6/2004 | Bates et al. | 422/4 |
| 2005/0005616 | A1 * | 1/2005 | Bates et al. | 62/77 |

(Continued)

*Primary Examiner* — Charles Kasenge
(74) *Attorney, Agent, or Firm* — Timothy M. Barlow

(57) ABSTRACT

Apparatus for automatic environmental control includes an enclosed, zoned structure. A heating, ventilation and air conditioning (HVAC) system is incorporated into the structure. Each zone includes separate controls, separately-controlled air flow into and out of each zone, and separate intake, vent, damper, thermostat and humidistat for each zone. Temperature and humidity are separately controllable for each zone, and controller is in communication with HVAC system for controlling HVAC system and for controlling the damper for each zone, the controller having a map comprising a plurality of relative humidity and temperature combinations and one or more actions for automatic execution based on the combinations of temperature and humidity. A temperature sensor, a relative humidity sensor are included in each zone, and an indicator array/interface panel is in communication with the controller. The system provides for the automatic elimination of environmental conditions favorable to mold and fungus growth for each zone individually.

10 Claims, 8 Drawing Sheets

U.S. PATENT DOCUMENTS

2005/0288824 A1* 12/2005 Fisher ..... 700/277
2006/0234382 A1* 10/2006 Wang et al. ..... 436/39
2007/0021872 A1* 1/2007 Fisher ..... 700/277
2007/0026107 A1* 2/2007 Wang et al. ..... 426/55
2007/0119957 A1* 5/2007 Kates ..... 236/94
2007/0180844 A1* 8/2007 Fujiyoshi et al. ..... 62/271
2007/0246553 A1* 10/2007 Morrow et al. ..... 236/46 R
2008/0014857 A1* 1/2008 Spadafora et al. ..... 454/229
2008/0141754 A1* 6/2008 Kates ..... 73/1.01
2008/0294291 A1* 11/2008 Salsbury ..... 700/277
2009/0192650 A1* 7/2009 Tonner ..... 700/276
2009/0259342 A1* 10/2009 Thomas et al. ..... 700/277

* cited by examiner

Start
131
240

132
Mold Warning ON?
N
Y
134
Turn OFF Lights
E
10
Observe current temperature (Tc) and relative humidity (RH)
14
16
RH ≥ 49%
20
RH ≥ 69%
28
RH ≥ 89%
18
GREEN
22
Tc ≤ 74°F
24
Tc ≥ 89°F
26
YELLOW
30
Tc ≤ 69°F
32
Tc ≥ 104°F
34
Tc ≤ 74°F
36
Tc ≥ 89°F
38
RED
40
Tc ≤ 64°F
42
Tc ≥ 104°F
44
Tc ≤ 69°F
46
Tc ≥ 94°F
48
Tc ≤ 74°F
50
Tc ≥ 89°F
52
FLASHING RED
135
F
224
MoldGuard ON?
227
ALERT PROGRAM
228
Calculate ΔT89 and ΔT74
230
ΔT89 > ΔT74
232
Turn ON Cooling
236
Turn ON Heating
G

AUTOMATIC MOLD AND FUNGUS GROWTH INHIBITION SYSTEM AND METHOD

PRIORITY DATA

This application claims priority from U.S. provisional application 61/104,707, filed Oct. 11, 2008.

FIELD OF THE INVENTION

The present invention relates generally to a duct type forced air system for a multi-zone space, and more particularly, to a variable air quantity, air humidity, and air quality control system capable of regulating temperature and humidity in each zone independently of other zones.

BACKGROUND OF THE INVENTION

Mold is a common allergen that can grow in many locations inside or outside a dwelling. It can also be found thriving inside building cavities, between walls. Mold is a very common indoor contaminant, and a common cause of illness. Only a few dozen of the thousands of different types of mold are commonly found in dwellings for humans.

Molds reproduce by releasing spores into the air. The spores are extremely small, about 1 micron or about 0.00004 inches. Mold counts are often 1,000 times higher than pollen counts. Although tiny parts of the parent mold colony can break off and be inhaled, usually, inhaled microscopic spores are the source of health problems. A person's allergic response is a biological reaction to the protein in mold, so the reaction can occur whether the inhaled spores are dead or alive. A thriving mold colony often releases various gases, including volatile organic compounds, that are also a problem for sensitive individuals.

Different species of mold have different health effects ranging from mild symptoms to death in some individuals. *Stachybotrys chartarum* (*Stachybotrys atra*) mold is being studied for possible links to AIPH (Acute Idiopathic Pulmonary Hemorrhage) among infants. Some species of the mold *Aspergillus* can infect the entire body of a person, causing lung damage or other serious illnesses. *Histoplasma capsulatum* can affect the lungs, but can also be systemic. A mold colony can use any organic material for food, and can even derive nutrition from a layer of dust on non-organic surfaces.

Mold requires five ingredients to thrive: food, air, a surface to grow upon, suitable temperature, and moisture. In an occupied building, little can be done to eliminate the first four conditions. In these instances, only the manipulation of moisture can be used to eliminate a mold colony or to prevent a new colony from forming. In an unoccupied building, temperature and humidity may be managed to control the commencement or continuing growth of a mold colony.

Another factor in mold growth is a change in barometric pressure. Sporalation can be encouraged by a reduction in the barometric pressure. In nature, a storm front and the accompanying higher humidity levels and wet weather are normally preceded by a reduction in barometric pressure.

Mold growth is related to relative humidity. Relative humidity levels below about 70% will not support excessive mold growth. However, indicated relative humidity levels below 70% do not ensure safety. Although a house may have 60% relative humidity, microclimates of higher relative humidity may exist throughout the house, especially near cooler surfaces. This is because cold air cannot support as much water moisture as warm air. Thus, for a given amount of water vapor in the air, the cooler air will have a higher relative humidity.

For example, assume the air in a house has a relative humidity of 60% at 21° C. (70° F.). The air outside the house is 10° C. (50° F.), and the air between the outside wall and the inner drywall is at 16° C. (60° F.). Furthermore, the air in the house and the air between the walls can circulate, which is very common. In this case, the 16° C. air within the wall cavity will have a relative humidity of 70%, and may support excessive mold growth.

Temperature, humidity and barometric pressure measurement and control are mature and well-developed arts. Numerous temperature and humidity measuring, monitoring, and controlling devices have been developed. However, each of these devices has shortcomings making them inappropriate or ineffective for monitoring and controlling indoor environmental conditions that are conducive to mold and fungus growth conditions.

Some of these prior art devices measure rainfall and emphasize temperature measurements to determine the potential for mold growth. Other devices measure surface wetness, or condensed water vapor, to determine the potential for mold growth. These devices are of little use indoors.

Other devices measure temperature, relative humidity or barometric pressure, and will alert a user when a single predetermined parameter is observed. However, such existing devices are not capable of determining when a combination of two or more conditions is observed. For example, mold growth depends on a specific relationship between temperature and moisture. Neither a specific temperature or moisture value nor a range of temperature or moisture values will provide optimal conditions for mold growth. Both temperature and relative humidity must be compared to determine if conditions are satisfactory for mold or fungus growth.

Thus, there exists a need for a device that alerts a homeowner or dwelling occupant to the unobvious combination of environmental conditions that are conducive to unseen and destructive mold and fungus growth and assigns a threat level to the problem. There is also a need for a device that provides suggestions to reduce the threat of mold growth. There is a further need for an energy efficient control system that can automatically manage the temperature and humidity in multiple zones to eliminate the mold and fungus growth threat.

According to the present invention there is provided a device to monitor and measure temperature, humidity, and barometric pressure changes, and control temperature and humidity conditions. There is also provided an indicator to warn when environmental conditions are favorable for undesirable growth such as mold, mildew, and fungi. The present invention provides suggestions to the user to allow the informed user to take steps to reduce or eliminate the environmental conditions that are beneficial for such unwanted growth.

It is an object of the invention to provide an automatic system and method that can determine the most efficient way to eliminate the environmental conditions that are beneficial for such unwanted mold and fungus growth.

It is another object of the invention to provide an automatic system and method for mold and fungus growth inhibition that controls each environmental zone in a manner that causes the least change in the temperature of the environment zone and which uses a minimum of energy.

SUMMARY OF THE INVENTION

In the following summary and description, the term "thermostat" is meant to convey a device provided to measure, monitor, and control temperature and humidity.

The thermostat device reads the temperature, relative humidity, and barometric pressure values from sensors, and compares the values to a data map to determine the corresponding hazard level for the specific combination of the temperature, relative humidity, and barometric pressure conditions. The thermostat indicates when environmental conditions are favorable or unfavorable for unseen and destructive organic infestations such as mold, mildew, and fungi. The relative hazard level is displayed visually or audibly. The rising level of potential for mold and fungus growth may be visually presented in a variety of ways. A text display may provide a numeric representation of the environmental conditions. A traffic signal configuration may show the increasingly favorable growth conditions as a change from a green indicator, to a yellow indicator, to a red indicator, and finally to a flashing red indicator warning of extreme susceptibility for unseen mold and fungus growth. In addition, the device may provide suggestions, via the text display, to allow a user to change the environmental conditions that contribute to the risk of organic infestation. If a "Mold-Guard" switch is active, and the user does not change the conditions favorable for biological infestation, the thermostat will proactively make judgments about the most efficient way to eliminate the environmental conditions that are beneficial for such unwanted growth, and automatically correct the undesirable conditions by adjusting one or more cooling, heating, ventilation, humidity, filtration, and ultraviolet light parameters.

The aforementioned objects and other intentions of the present objective are attained by a one heating and cooling unit zoned system comprising a single master programmable thermostat for programming desired temperatures and humidity schedules for a plurality of zones, a plurality of zone dampers controlling the desired temperature and humidity in a respective one of the zones, individual zone temperature and humidity measuring means for measuring the actual temperature and humidity in a respective zone and for overriding the desired temperature and humidity set point of the master thermostat in a respective zone until the "Mold-Guard" switch is deactivated or until the conditions within the zone are no longer conducive to excessive mold growth.

BRIEF DESCRIPTION OF THE DRAWINGS

Other objects and advantages of the present invention will be apparent from the following detailed description in conjunction with the accompanying drawings in which reference numerals designate like or corresponding parts throughout the same, in which.

DETAILED DESCRIPTION OF THE DRAWINGS

Figure 1:
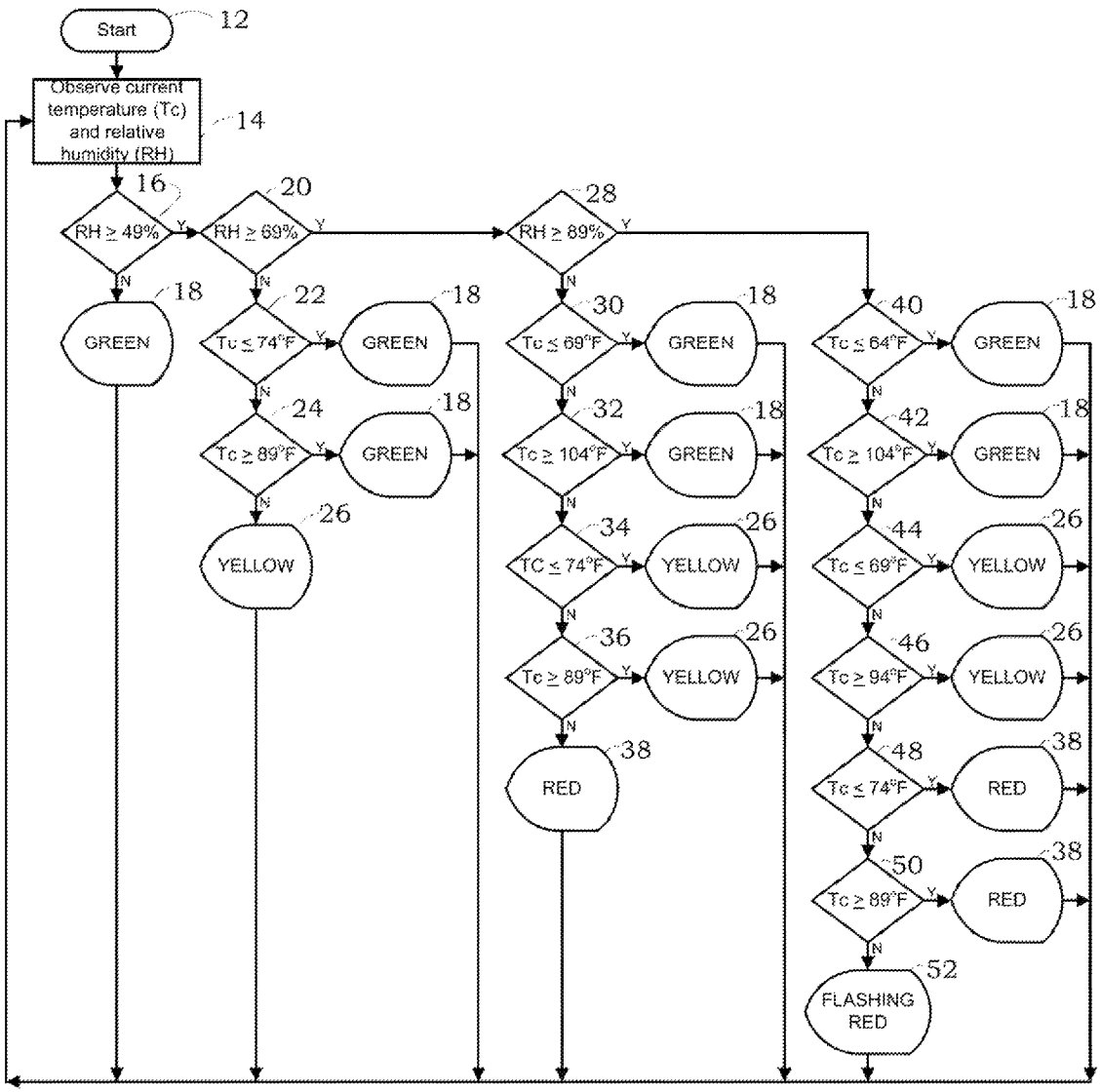
Fig. 1 Prior Art
FIG. 1 illustrates a flowchart of a prior art mold growth warning apparatus.

In accordance with the present invention, a device and method are provided to monitor temperature, humidity and barometric pressure conditions. The device reads the temperature, relative humidity and barometric pressure values from a data map to determine the corresponding hazard level for the observed temperature, relative humidity and barometric pressure conditions. The device indicates when environmental conditions are favorable or unfavorable for unseen and destructive organic infestations such as mold, mildew, and fungi. The device provides suggestions or instructions to the user to enable the user to change the combination of environmental conditions to reduce the risk of organic infestation. In addition, the device and method provide for a system that can automatically, and in an efficient manner, eliminate environmental conditions favorable for mold and fungus growth for an entire dwelling or structure, or for a particular zone or zones within the dwelling or structure.

Conventional residential (and many commercial) forced air systems (which can provide both heating and cooling) are typically controlled with a single thermostat. Accordingly, the one set point in the thermostat will cause the temperature and humidity in the vicinity of the thermostat to be controlled to the desired level, but in other parts of the residence the temperature and humidity can vary widely due to heat load through windows, shading of spaces, heat and humidity generated by people or appliances, and various other factors such as external weather conditions. Thus, certain places in homes require more or less temperature and humidity control than others. In addition, some areas in a dwelling can support a higher humidity level for a longer period, without deleterious effects, than other areas in a residence. Upstairs areas have drastically different heating/cooling requirements than downstairs areas or basements. Interior areas of water usage such as laundry rooms, kitchens, and bathrooms present extreme difficulties for maintaining a desired level of relative humidity. With a single centrally-located thermostat it is impossible to have optimum temperatures and humidities in all zones/rooms at all times. In a zoned residence, however, individual zones with differing heating/cooling properties and hours of use can be kept at optimum temperatures and humidities.

One zoning method uses separate heating and cooling units to maintain different comfort levels in different parts of the residence. However, each system uses its own thermostat which is centrally located in a zone to be maintained by the respective system, but, because the separate units do not function as a system, they may overlap in heating and cooling some areas and perform as two independent systems.

To overcome the added installation costs, added expense to operate, and the overlap problems with dual equipment zoned systems, the use of one heating and cooling unit with a series of thermostats in each room can be provided. A single unit zoned system allows different parts of a residence to be controlled at different temperatures and humidities at different times by programming each thermostat in each zone for a desired temperature over a period of time. Although the single-zoned heating and cooling unit offers cost savings, greater comfort, and greater flexibility by allowing the homeowner to set different temperatures throughout the house only during times of need or occupancy, these single heating and cooling units with multiple programmable thermostats also have some disadvantages. Conventional single-heating and cooling zoned systems allow each individual thermostat to turn on the heating and cooling unit and operate the zone damper in the respective zones. In practice, this system is quite complicated to operate and inefficient because the several individual thermostats can turn the heating and cooling unit ON and OFF and each zone must be individually programmed for the desired temperature and schedule, and there is no central control. Further, using short bursts of cooling by a large system to cool a small zone may lead to excessive humidity, even though the temperature is in a comfortable range. Often it is desirable to temporarily change the temperature setpoint in a single zone during the pre-set program period. Further, it is often desirable to temporarily prevent the temperature setpoint in a zone from changing with a pre-set program schedule. Still further, it is often desirable to temporarily change all zone setpoints and time schedules, e.g. during vacation periods. These problems require the user to re-program the controller for a short period and then re-program the controller again shortly thereafter to set in the original schedule.

Other conventional devices teach energy conserving thermostats with temperature settings for comfort during scheduled times, and energy saving temperatures during other scheduled times. Other devices disclose methods for controlling temperatures in multiple locations for comfort during scheduled times, and energy saving temperatures during other scheduled times. Further devices teach a controller that maintains programmed temperatures for specific periods in multiple zones having hold, override and vacation modes, to save energy.

Energy saving thermostats are beneficial in most conditions. However, when the air becomes excessively humid, and the energy saving feature allows elevated temperatures, mold and fungus can grow rapidly. Such settings of energy saving thermostats may allow mold infestation to grow by compounding on previous growth. For example: during the first hypothetical occurrence of high humidity and high temperature allowed by an energy saving thermostat, mold may grow by 10%. During the next occurrence mold may grow by 10% added to the previous 10%, resulting in 21% growth. The third occurrence will result in 33% total growth, and so on. Each occurrence is important because mold will lie dormant until the next growth condition, and will not diminish.

Other devices disclose methods to control maximum humidity in an air conditioned space by varying the "on" time of an air conditioner. Such devices teach the use of a controller for heating, cooling, ventilation, filtration, humidifying and dehumidifying, and an ultraviolet lamp, and that signals the user when servicing is required. Also known are mold detection apparatuses whereby the likelihood of mold growth is indicated by a temperature/humidity or a temperature/humidity/pressure look-up table.

FIG. 1 is a flowchart of a prior art mold growth warning apparatus and illustrates a method to detect conditions for excessive mold growth and to warn a user about such conditions by means of green, yellow, red, or flashing red light.

Referring to FIG. 1 the flowchart 10 is entered at block 12 and control is passed to block 14. Block 14 observes the current temperature (Tc) and relative humidity (RH) of the inside space, such as element 142 of FIG. 4. A decision step 16 follows which chooses a path depending on whether the relative humidity is greater than or equal to 49%. If the relative humidity is not greater than or equal to 49% then a green light 18 is illuminated, and control passes to block 14 which again observes the current temperature (Tc) and relative humidity (RH) of the inside space. If decision step 16 decides that the relative humidity is 49% or greater, control is passed to decision step 20.

Decision step 20 chooses a path depending on whether the observed relative humidity is greater than or equal to 69%. If the relative humidity is not greater than or equal to 69%, control passes to decision step 22 which chooses whether the observed temperature (Tc) is less than or equal to 74° F. If the current temperature is less than or equal to 74° F. green light 18 is illuminated, and control passes to block 14 which again observes the current temperature (Tc) and relative humidity (RH) of the inside space. If decision step 22 decides that the observed temperature (Tc) is not less than or equal to 74° F., control is passed to decision step 24, which chooses whether the observed temperature (Tc) is greater than or equal to 89° F. If the current temperature is greater than or equal to 89° F. green light 18 is illuminated, and control passes to block 14 which again observes the current temperature (Tc) and relative humidity (RH) of the inside space. If decision step 24 decides that the observed temperature (Tc) is not greater than or equal to 89° F., a yellow light 26 is illuminated, and control passes to block 14 which again observes the current temperature (Tc) and relative humidity (RH) of the inside space.

If decision step 20 decides that the relative humidity is greater than or equal to 69%, control passes to decision step 28. Decision step 28 chooses a path depending on whether the observed relative humidity is greater than or equal to 89%. If the relative humidity is not greater than or equal to 89%, control passes to decision step 30 which chooses whether the observed temperature (Tc) is less than or equal to 69° F. If the current temperature is less than or equal to 69° F. green light 18 is illuminated, and control passes to block 14 which again observes the current temperature (Tc) and relative humidity (RH) of the inside space. If decision step 30 decides that the observed temperature (Tc) is not less than or equal to 69° F., control is passed to decision step 32, which chooses whether the observed temperature (Tc) is greater than or equal to 104° F. If the current temperature is greater than or equal to 104° F. green light 18 is illuminated, and control passes to block 14 which again observes the current temperature (Tc) and relative humidity (RH) of the inside space. If decision step 32 decides that the observed temperature (Tc) is not greater than or equal to 104° F., control is passed to decision step 34, which chooses whether the observed temperature (Tc) is less than or equal to 74° F. If the current temperature is less than or equal to 104° F. yellow light 26 is illuminated, and control passes to block 14 which again observes the current temperature (Tc) and relative humidity (RH) of the inside space. If decision step 34 decides that the observed temperature (Tc) is not less than or equal to 74° F., control is passed to decision step 36, which chooses whether the observed temperature (Tc) is greater than or equal to 89° F. If the current temperature is greater than or equal to 89° F., yellow light 26 is illuminated, and control passes to block 14 which again observes the current temperature (Tc) and relative humidity (RH) of the inside space. If decision step 36 decides that the observed temperature (Tc) is not greater than or equal to 89° F., a red light 38 is illuminated, and control passes to block 14 which again observes the current temperature (Tc) and relative humidity (RH) of the inside space.

If decision step 28 decides that the relative humidity is greater than or equal to 89%, control passes to decision step 40. Decision step 40 chooses a path depending on whether the observed temperature (Tc) is less than or equal to 64° F. If the current temperature is less than or equal to 64° F. green light 18 is illuminated, and control passes to block 14 which again observes the current temperature (Tc) and relative humidity (RH) of the inside space. If decision step 40 decides that the observed temperature (Tc) is not less than or equal to 64° F., control is passed to decision step 42, which chooses whether the observed temperature (Tc) is greater than or equal to 104° F. If the current temperature is greater than or equal to 104° F. green light 18 is illuminated, and control passes to block 14 which again observes the current temperature (Tc) and relative humidity (RH) of the inside space. If decision step 42 decides that the observed temperature (Tc) is not greater than or equal to 104° F., control is passed to decision step 44, which chooses whether the observed temperature (Tc) is less than or equal to 69° F. If the current temperature is less than or equal to 69° F. yellow light 26 is illuminated, and control passes to block 14 which again observes the current temperature (Tc) and relative humidity (RH) of the inside space. If decision step 44 decides that the observed temperature (Tc) is not less than or equal to 69° F., control is passed to decision step 46, which chooses whether the observed temperature (Tc) is greater than or equal to 94° F. If the current temperature is greater than or equal to 94° F., yellow light 26 is illuminated, and control passes to block 14 which again observes the current temperature (Tc) and relative humidity (RH) of the inside space. If decision step 46 decides that the observed temperature (Tc) is not greater than or equal to 94° F., control is passed to decision step 48, which chooses whether the observed temperature (Tc) is less than or equal to 74° F. If the current temperature is less than or equal to 74° F., red light 38 is illuminated, and control passes to block 14 which again observes the current temperature (Tc) and relative humidity (RH) of the inside space. If decision step 48 decides that the observed temperature (Tc) is not less than or equal to 74° F., control is passed to decision step 50, which chooses whether the observed temperature (Tc) is greater than or equal to 89° F. If the current temperature is greater than or equal to 89° F., red light 38 is illuminated, and control passes to block 14 which again observes the current temperature (Tc) and relative humidity (RH) of the inside space. If decision step 50 decides that the observed temperature (Tc) is not greater than or equal to 89° F., red light 38 is illuminated and switched on and off to become a flashing red light 52. Control is then passed to block 14 which again observes the current temperature (Tc) and relative humidity (RH) of the inside space.

Figure 2:
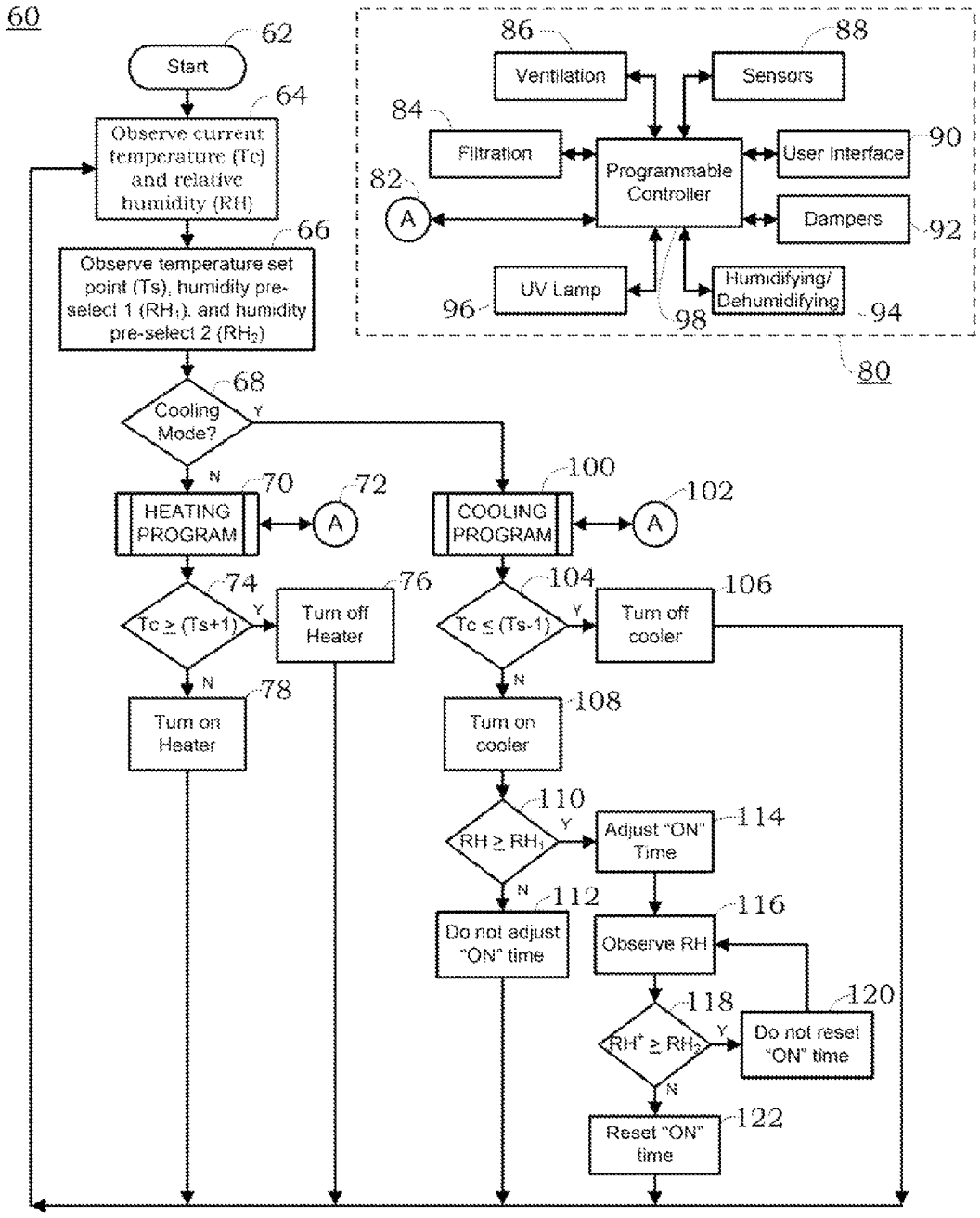
Fig. 2 Prior Art
FIG. 2 illustrates a flowchart of prior art methods to control humidity and temperature.

FIG. 2 is a flowchart that combines the prior art for thermostats and methods to control humidity. Referring to FIG. 2 the flowchart 60 is entered at block 62 and control is passed to block 64. Block 64 observes the current temperature (Tc) and relative humidity (RH) of the inside space, such as element 142 of FIG. 4. Another observation step follows block 64. Step 66 observes the temperature set point (Ts), the first humidity pre-select level ($RH_1$) and the second humidity pre-select level ($RH_2$). Decision step 68 follows and chooses a path depending on whether unit 60 has a cooling mode enabled.

If decision step 68 finds that the cooling mode is not enabled, control is passed to a heating program 70. Heating program 70 has an interface 72 that may interactively enable functions of heating/cooling subroutine 80 through heating/cooling subroutine interface 82.

Referring to heating/cooling subroutine 80, a block diagram of an illustrative HVAC system is shown. the system includes a programmable controller 98. Programmable controller 98 may be operatively connected to one or more system components that can be activated to regulate various environmental conditions such as temperature, humidity, and air quality levels occurring within a structure. As shown in FIG. 2, for example, the programmable controller 98 can be connected to a heating unit program 70 and a cooling unit program 100 that can be activated to maintain the structure at a particular temperature level. A ventilation unit 86 such as a fan or blower equipped with one or more dampers may be employed to regulate the volume of air delivered to the various rooms of the structure. A filtration unit 84, UV lamp unit 96, and humidifier/dehumidifier unit 94 may also be provided to regulate the air quality and moisture levels within the structure. One or more local and/or remote sensors 88 as well as other system components can also be connected to programmable controller 98 to monitor and regulate the environment, as desired. The system components may be directly connected to a corresponding Input/Output (I/O) port or I/O pins on programmable controller 98, and/or connected to the controller via a network or the like, as desired.

Programmable controller 98 may include a user interface 90 that allows a user or service technician to transmit signals to and from the programmable controller 98. User interface 90 can include a touch screen, a liquid crystal display (LCD) panel and keypad, a dot matrix display, a computer, and/or any other suitable device for sending and receiving signals to and from programmable controller 98. Programmable controller 98 can be configured to display servicing information on user interface 90 to notify the user when a fault or malfunction has been detected, or when servicing is necessary or desirable. Alternatively, or in addition, programmable controller 98 may be programmed to automatically contact a designated contractor, a service referral organization, a utility, a retailer, a manufacturer, and/or some other person or organization, requesting service for any detected system anomalies. User interface 90 is also used to set the unit to operate in any variety of modes, and is also used to manually reset these modes, override, and set for automatic override of the set program. A damper control process 92 is also shown. Damper control process 92 is useful in directing conditioned air to an individual zone or plurality of zones that require it when detected by programmable controller 98.

Programmable controller 98 may include a processor (e.g. a microprocessor/CPU), a storage memory, a clock, and an I/O interface that connects programmable controller 98 to the various system components illustrated in FIG. 2. Internal sensors located within programmable controller 98 can be employed to measure the temperature, humidity levels and/or other environmental conditions occurring within the structure. In some cases, the sensors 88 may be external to programmable controller 98.

After interactive operation with programmable controller 98, control is passed again to heating program 70, and then to decision step 74. Decision step 74 chooses whether the current temperature is equal to or greater than the temperature set point plus 1° F. If the current temperature is equal to or above the temperature set point plus 1° F., control is passed to block 76 which turns off the heater. Control is then passed to block 64 which again observes the current temperature (Tc) and relative humidity (RH) of the inside space. If decision step 74 determines that the current temperature is not equal to or above the temperature set point plus 1° F., control is passed to block 78 which turns off the heater. Control is then passed to block 64 which again observes the current temperature (Tc) and relative humidity (RH) of the inside space.

If decision step 68 finds that the cooling mode is enabled, control is passed to a cooling program 100. Cooling program 100 has an interface 102 that may interactively enable functions of heating/cooling subroutine 80 through heating/cooling subroutine interface 82. As explained previously, referring to heating/cooling subroutine 80, the system includes a programmable controller 98 that 98 may be operatively connected to one or more system components that can be activated to regulate various environmental conditions such as temperature, humidity, and air quality levels occurring within a structure.

After interactive operation with programmable controller 98, control is passed again to cooling program 100, and then to decision step 104. Decision step 104 chooses whether the current temperature (Tc) is equal to or less than the temperature set point (Ts) minus 1° F. If current temperature (Tc) is equal to or below temperature set point (Ts) minus 1° F., control is passed to block 106 which turns off the cooling device. Control is then passed to block 64 which again observes current temperature (Tc) and relative humidity (RH) of the inside space.

If decision step 104 finds that current temperature (Tc) is not equal to or less than temperature set point (Ts) minus 1° F., control is passed to block 108 which activates the cooling device. Control is then passed to decision step 110 which determines whether the relative humidity (RH) is equal to or greater than the first pre-selected relative humidity level ($RH_1$). If relative humidity (RH) is not equal to or above first pre-selected relative humidity level ($RH_1$), control is passed to block 112. Block 112 does not adjust the minimum on time of the cooling unit and returns control to block 64 which again observes current temperature (Tc) and relative humidity (RH) of the inside space.

If decision step 110 finds that relative humidity (RH) is equal to or above first pre-selected relative humidity level ($RH_1$), control is passed to block 114. Block 114 adjusts the minimum on time of the cooling unit in an attempt to reduce the humidity level of the inside space. Preferably, after a time delay, control then passes to block 116 which again observes the relative humidity (RH) of the inside space. Control then passes to decision step 118 which determines if the updated relative humidity ($RH^+$) is equal to or above the second pre-selected relative humidity level ($RH_2$). Second pre-selected relative humidity level ($RH_2$) may be lower than first pre-selected relative humidity level ($RH_1$), which helps introduce hysteresis into the system. If decision step 118 finds that updated relative humidity level ($RH^+$) is equal to or above second pre-selected relative humidity level ($RH_2$), control passes to block 120 which does not reset the minimum on time of the cooling unit to its original value. Control is then returned to block 64, which again observes current temperature (Tc) and relative humidity (RH) of the inside space.

If decision step 118 finds that updated relative humidity level ($RH^+$) is not equal to or above second pre-selected relative humidity level ($RH_2$), control passes to block 122 which resets the minimum on time of the cooling unit to its original value. Control is then returned to block 64, which again observes current temperature (Tc) and relative humidity (RH) of the inside space.

Figure 3A:
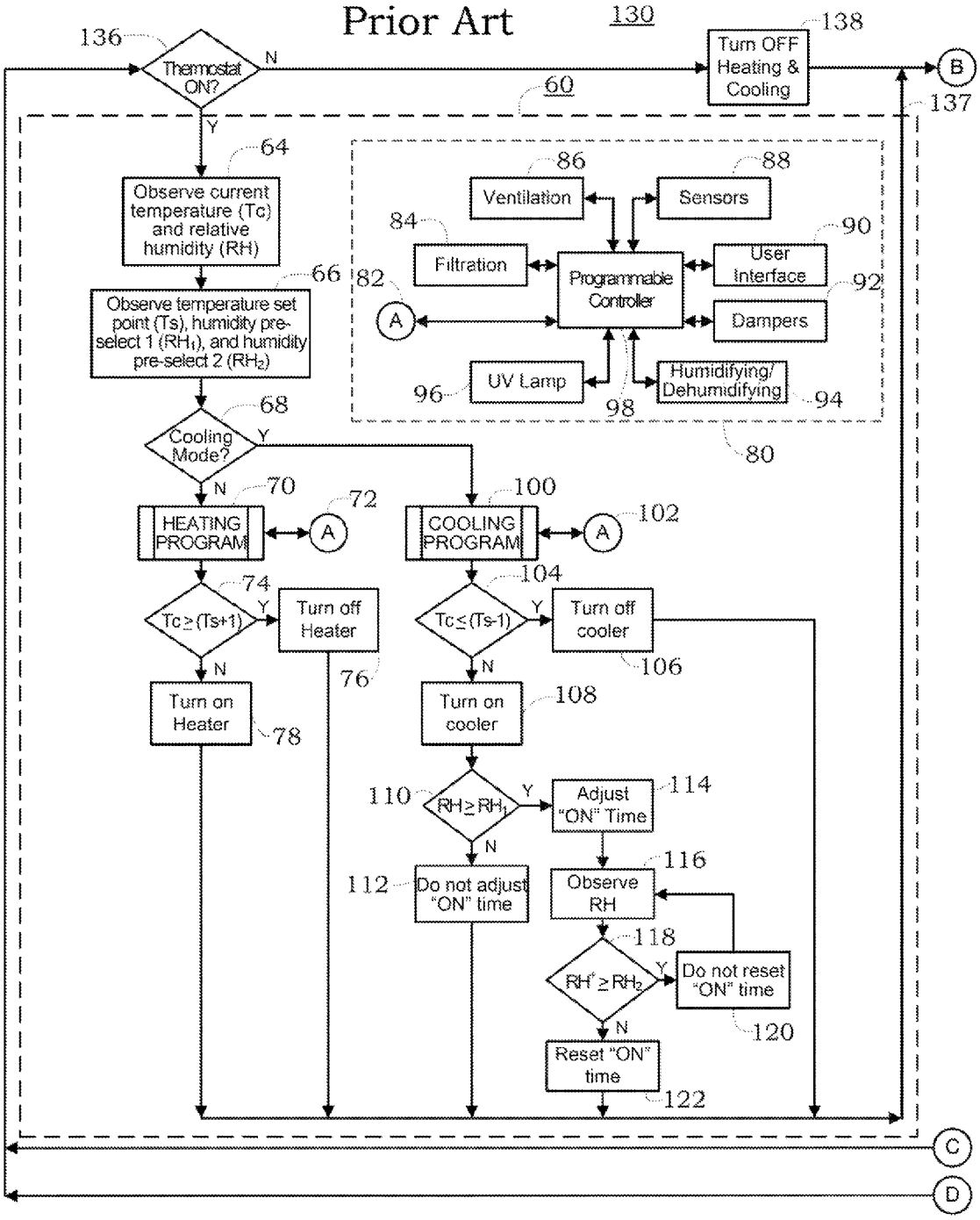
Fig. 3A Prior Art
FIG. 3 illustrates a flowchart combining prior art mold growth devices with a prior art humidity thermostat controller and a programmable thermostat controller.
Figure 3B:
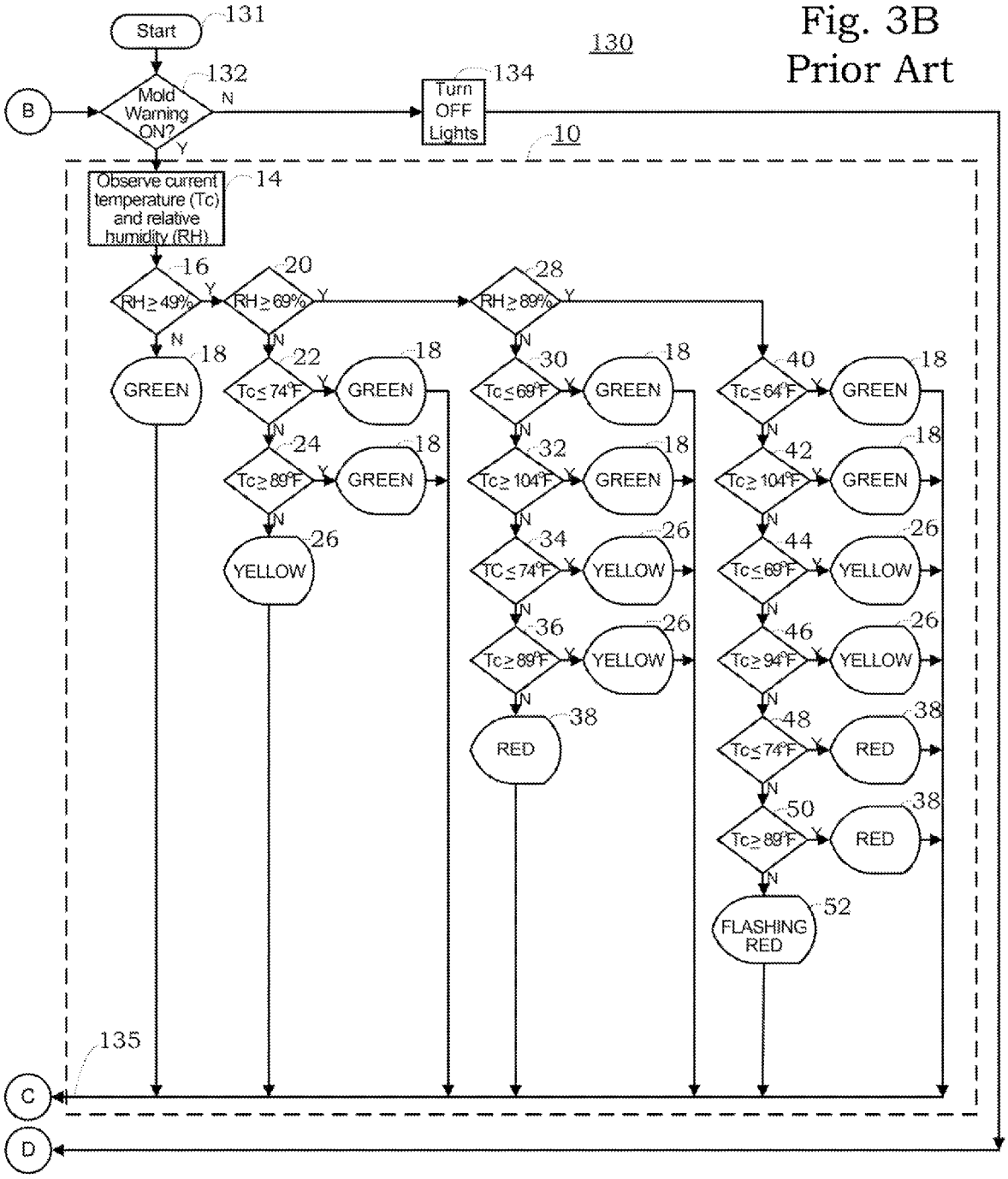
Fig. 3B Prior Art

FIG. 3 is a flowchart combining a prior art mold growth warning apparatus, a prior art humidity thermostat controller, and a programmable thermostat controller. Referring now to FIG. 3, those skilled in the art may see that the prior art teachings may be combined to achieve a device that can monitor the propensity for mold growth in an interior space and actively control the temperature and humidity in that space 130.

However, the combined teachings will not yield a device that will actively control the interior space to reduce the probability of mold growth, such as the present invention. The control flowchart for a prior art mold growth warning apparatus 10 is shown. A flowchart for a prior art programmable thermostat with humidity control 60 is also shown. The addition of several steps allow the two units to work simultaneously as thermostat and humidity controller with mold growth warning device 130. In operation, the flowchart is entered at block 131. Control is then passed to decision step 132. Decision step 132 determines if mold growth warning device 10 is enabled. If mold growth warning device 10 is enabled control is passed to block 14 and then through the remaining steps of the flow chart for mold growth warning device 10. Control exits mold growth warning device 10 at location 135 and travels to decision step 136. Decision step 136 determines if thermostat with humidity control 60 is enabled. If decision step 136 determines that thermostat with humidity control 60 is enabled control is passed to block 64 and then through the remaining steps of the flow chart for thermostat with humidity control device 60. Control exits thermostat with humidity control device 60 at location 137 and travels back to decision step 132 to determine if mold growth warning device 10 is enabled.

If mold growth warning device 10 is not enabled control is passed to block 134 which turns off the lights of mold growth warning device 10. Control bypasses mold growth warning device 10 and travels to decision step 136. Decision step 136 determines if thermostat with humidity control 60 is enabled. If decision step 136 determines that thermostat with humidity control 60 is enabled control is passed to block 64 and then through the remaining steps of the flow chart for thermostat with humidity control device 60. Control exits thermostat with humidity control device 60 at location 137 and travels back to decision step 132 to determine if mold growth warning device 10 is enabled.

After determining at decision step 134 whether mold growth warning device 10 is enabled, control passes to decision step 136. If decision step 136 determines that thermostat with humidity control 60 is not enabled, control passes to block 138 which turns off the heating and cooling controls. Control then travels back to decision step 132 to determine if mold growth warning device 10 is enabled.

From the description of the flowchart of FIG. 3 and the combined prior art teachings, above, it can be determined that mold growth warning device 10 and thermostat with thermostat with humidity control device 60 will operate sequentially. The process decisions of mold growth warning device 10 will not affect the decisions of thermostat with humidity control device 60.

Therefore, interactive operation is impossible.

For example, although mold growth warning device 10 may show that interior space conditions are very conducive for mold growth (red light 52 is illuminated and flashing), thermostat with humidity control 60 will not operate differently. In fact, if thermostat with humidity control 60 is turned off, the interior space condition may continue to degrade (flashing red light 52).

The combination of the prior art can also lead to very inefficient behavior. For example if thermostat with humidity control 60 is set to a low humidity ($RH_1$) primarily to avoid mold growth, the air conditioner will run until this humidity is achieved. During this period the air temperature will decrease and energy will be used to decrease the humidity level. Since it is the combination of temperature and humidity that determines mold growth, a very slight decrease in humidity and temperature may be all that is needed to abate mold growth. Mold growth warning device 10 will indicate this, but thermostat with humidity control 60, being noninteractively connected, will not change its behavior to take advantage of this, and will waste energy.

In addition, the combination of the prior art is overly complicated for the intended use of active mold abatement.

There is no prior art for a device that actively controls temperature and humidity in individual zones from the perspective of comfort, energy savings and mold growth. There is no reason or suggestion in the prior art for one skilled in the art to combine the teachings of the prior art to construct a device capable of controlling temperature and humidity to combat mold growth, but such a device would have the obvious disadvantage of wasting energy during operation. Also, such a device might require excessive "on" time of the air conditioner which wastes energy and may cool a zone many degrees below a comfortable range in order to reduce the humidity to prevent mold growth. The present invention teaches several unobvious features to overcome the energy wasting disadvantage found when combining prior art, and allows a device that can control the temperature and humidity in a habitat in such a way as to actively suppress mold growth and save energy.

Figure 4:
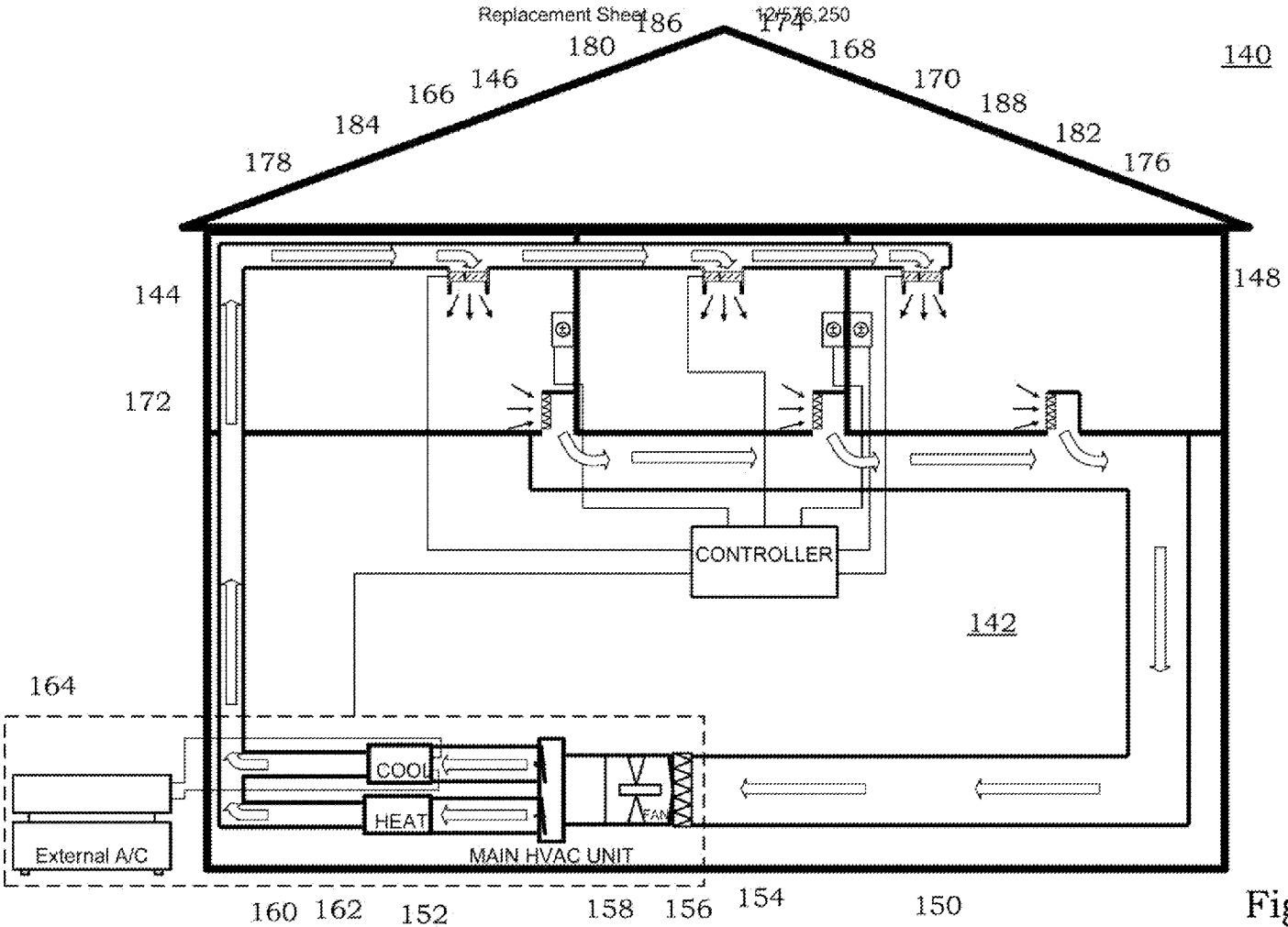
FIG. 4 illustrates a highly diagrammatic schematic view of an HVAC system having an automatic mold and fungus growth inhibition device, in accordance with the present invention.

FIG. 4 is a highly diagrammatic schematic view of an HVAC system 140 adapted to control an inside space 142 of a building or other structure, according to the present invention. In the illustrative embodiment, HVAC system 140 is used to control the temperature, humidity and/or other environmental parameters of inside space 142, in which a first zone 144, a second zone 146, and a third zone 148 have been defined. Whereas a multi-zoned HVAC system is shown, it is contemplated that a single-zoned HVAC system can also be used if desired.

The illustrative HVAC system includes a controller 150 which controls a main HVAC unit 152. Main HVAC unit 152 is comprised of an air filter 154, a fan or blower 156, an air routing valve 158, a cooling unit 160 and a heating unit 162. Main HVAC unit 152 may include an external air conditioner unit 164, which may have parts outside of defined inside space 142. As shown in FIG. 4, the cooling unit has an external air conditioner unit 164 usually consisting of a compressor and heat exchanger located outside of defined inside space 142, and internal air conditioning unit 160 usually consisting of air conditioning coils within a plenum connected to the duct work within the inside space 142. In some embodiments, the air conditioner is a constant volume rooftop unit, commonly used in some residential and commercial applications, and/or may be single or multi-stage unit.

Preferably, controller 150 gathers information about temperatures and humidity levels of inside space 142 from a first thermostat/humidistat 166 in first zone 144, a second thermostat/humidistat 168 in second zone 146, and a third thermostat/humidistat 170 in third zone 148. An air intake 172 is shown in first zone 144, a second intake 174 is shown in second zone 146, and a third intake 176 is shown in third zone 148. A first vent 178 feeds air into first zone 144, a second vent 180 feeds air into second zone 146, and a third vent 182 feeds air into third zone 148. A first damper 184 controls whether, and how much, air is forced through first vent 178 and into first zone 144, a second damper 186 controls whether, and how much, air is forced through second vent 180 and into second zone 146, and a third damper 188 controls whether, and how much, air is forced through third vent 182 and into third zone 148.

During a cooling operation, controller 150 may sense whether any of thermostats/humidistats 166, 168 or 170 indicate a call for cooling. If there is a call for cooling, controller 150 activates blower 156 and cooling unit 160 of main HVAC unit 152. Controller 150 may also control the position of dampers 184, 186, and/or damper 188. For example, if first thermostat/humidistat 166 indicates a call for cooling and second and third thermostat/humidistats 168 and 170 do not, controller 150 may close second and third dampers 186 and 188 to prevent cool air from being supplied to second zone 146 and third zone 148, and open first damper 184 to allow cool air to be supplied to first zone 144. Once thermostats/humidistats 166, 168, and 170 indicate that the temperature in each respective zone 144, 146, and 148 are at or below a predetermined temperature set point, controller 150 may turn off cooling unit 160, and blower 156. Some HVAC systems may also include a furnace for heating inside space 142. Heating operations may be performed in a manner similar to that described above.

Figure 5:
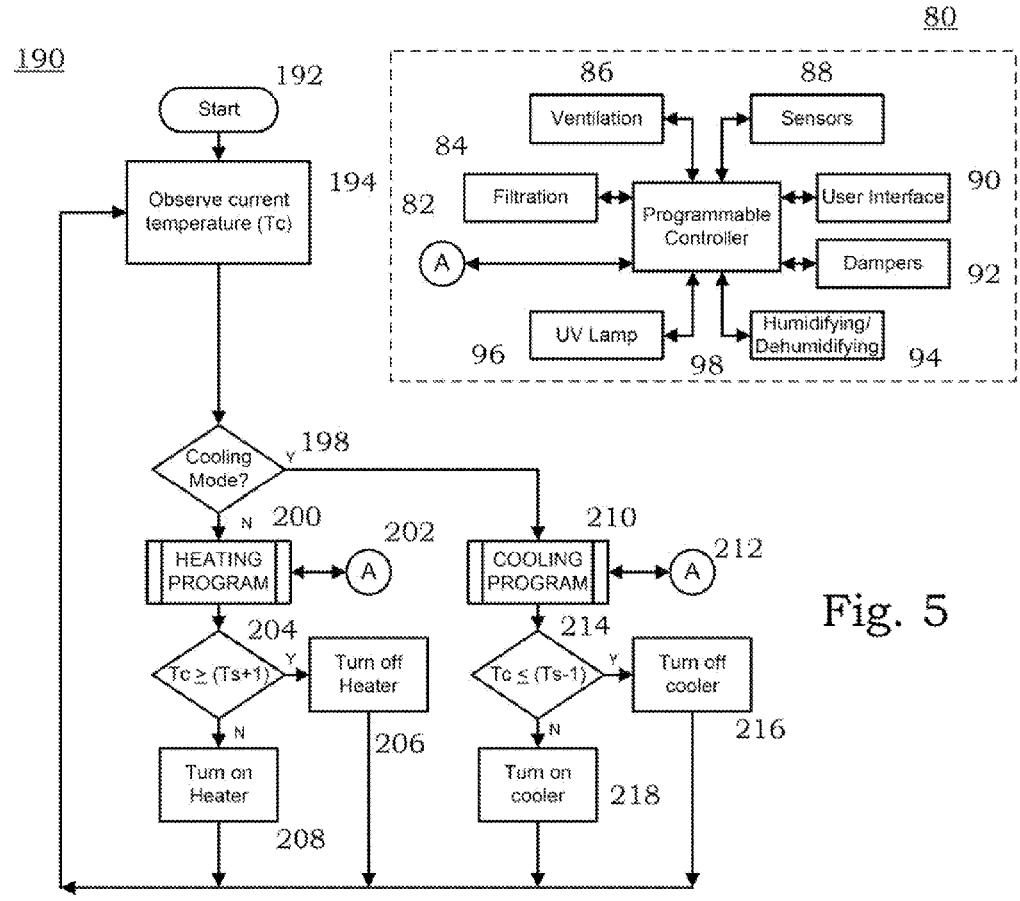
FIG. 5 illustrates a flowchart of a simplified thermostat controller, in accordance with the present invention.

Referring now to FIG. 5 a simple thermostat flowchart 190 is shown. Flowchart 190 is entered at block 192. Control is then passed to block 194 which observes the current temperature (Tc) of interior space 142 of FIG. 4. Control is then passed to decision step 198. Decision step 198 determines if HVAC system 140 of FIG. 4 is in a cooling mode. If Cooling is not enabled, control is passed to a heating program 200. Heating program 200 has an interface 202 that may interactively enable functions of heating/cooling subroutine 80 through heating/cooling subroutine interface 82. The components and operation of heating/cooling subroutine 80 have been described previously.

After returning to simple thermostat flowchart from heating/cooling subroutine 80, control is passed to decision step 204. Decision step 204 determines if the current temperature (Tc) is greater than or equal to temperature setpoint (Ts) plus 1. If current temperature Tc is greater than or equal to current temperature plus 1, control is passed to block 206 and the heater is turned off. Control is then passed to block 194 which again observes current temperature (Tc). If decision step 204 determines that current temperature Tc is not greater than or equal to current temperature plus 1, control is passed to block 208 and the heater is turned on. Control is then passed to block 194 which again observes current temperature (Tc).

If decision step 198 determines that HVAC system 140 of FIG. 4 is in a cooling mode, control is passed to a cooling program 210. Cooling program 210 has an interface 212 that may interactively enable functions of heating/cooling subroutine 80 through heating/cooling subroutine interface 82. The components and operation of heating/cooling subroutine 80 have been described previously.

After returning to simple thermostat flowchart from heating/cooling subroutine 80, control is passed to decision step 214. Decision step 214 determines if the current temperature (Tc) is less than or equal to temperature setpoint (Ts) minus 1. If current temperature Tc is less than or equal to current temperature minus 1, control is passed to block 216 and the cooling system is turned off. Control is then passed to block 194 which again observes current temperature (Tc). If decision step 214 determines that current temperature Tc is not less than or equal to current temperature minus 1, control is passed to block 218 and the cooling system is turned on. Control is then passed to block 194 which again observes current temperature (Tc).

Figure 6:
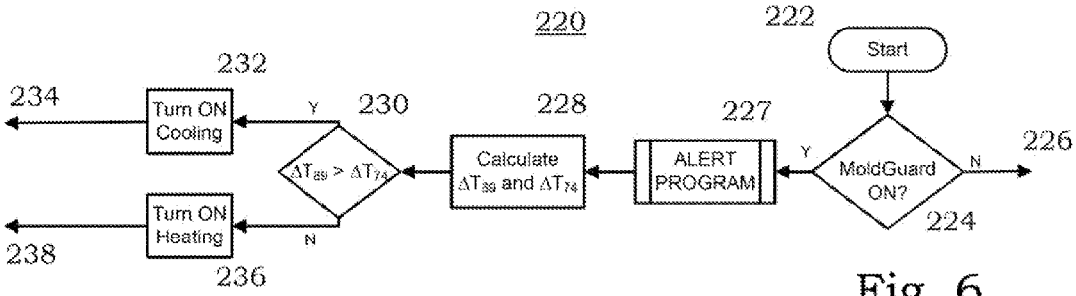
FIG. 6 illustrates a flowchart of a subroutine for an automatic mold and fungus growth inhibition device, in accordance with the present invention.

Referring now to FIG. 6 a MoldGuard flowchart 220 is shown. MoldGuard function 220, when enabled, can overide temperature setpoint (Ts) and allow the HVAC system to operate in an energy efficient manner by determining if it is more efficient to raise or lower current temperature (Tc) to combat mold and fungus growth.

MoldGuard flowchart 220 is entered at step 222. Control is then passed to decision step 224 which determines if the MoldGuard function is enabled. If the MoldGuard function is not enabled, control is routed through connector 226 and back to the main flowchart. If the MoldGuard function is enabled control is passed to an alert program 227. Alert program 227 may call an appropriate person or organization when Mold- Guard unit 220 is active. It is contemplated that alert program 227 may contact an appropriate person such as the tenant, homeowner, or maintenance person, or a responsible organization such as a security monitoring service via an internet connection, wireless connection, or any other suitable communication method as desired. Control is then passed to block 228. Block 228 calculates two parameters. The first parameter is $\Delta T_{89}$ which is defined as the difference between current temperature (Tc) and a temperature of 89° F. The second parameter is $\Delta T_{74}$ which is defined as the difference between current temperature (Tc) and a temperature of 74° F. Control is then passed to decision step 230. Decision step 230 determines if $\Delta T_{89}$ is greater than $\Delta T_{74}$. If $\Delta T_{89}$ is greater than $\Delta T_{74}$, control is passed to block 232 which turns on the cooling system. Control is then routed back to the main flowchart through connector 234. If decision step 230 determines that $\Delta T_{89}$ is not greater than $\Delta T_{74}$, control is passed to block 236 which turns on the heating system. Control is then routed back to the main flowchart through connector 238.

The decision-making process of FIG. 6 will now be described in more detail. Let us take for example a situation where the program has decided that the temperature is between 74° F. and 89° F. Thus, there is an mold alert condition (step 227), and the system must do something to get the temperature out of the 74° F. to 89° F. range and thereby make the environmental conditions less favorable for mold and fungus growth.

Let us assume for this example that the temperature is 80° F. Step 228 will calculate the difference between 89° F. and 80° F. (9° F. delta) and between 74° F. and 80° F. (6° F. delta). Step 230 decides if the difference between 89° F. and 80° F. is larger than the difference between 74° F. and 80° F. Since the difference between 89° F. and 80° F. is greater than the difference between 74° F. and 80° F., the cooling is turned on in Step 232.

Let's take a more extreme example: The alert temperature is 88° F. In step 228, the program calculates that the difference between 89° F. and 88° F. is 1° F., and the difference between 74° F. and 88° F. is 14° F. In step 230, the program determines that the difference between 89° F. and 88° F. is not greater than the difference between 74° F. and 88° F., and, thus, turns on the heating.

The system is arranged to take the path of least resistance. If the air is at 88° F. and we want it to be 89° F. or 74° F., it is determined that it will require less energy to heat the air 1 degree (to achieve 89° F.) than it will take to cool the air 14° F. (to achieve 74° F.).

Operation of the Preferred Embodiment

Figure 7A:
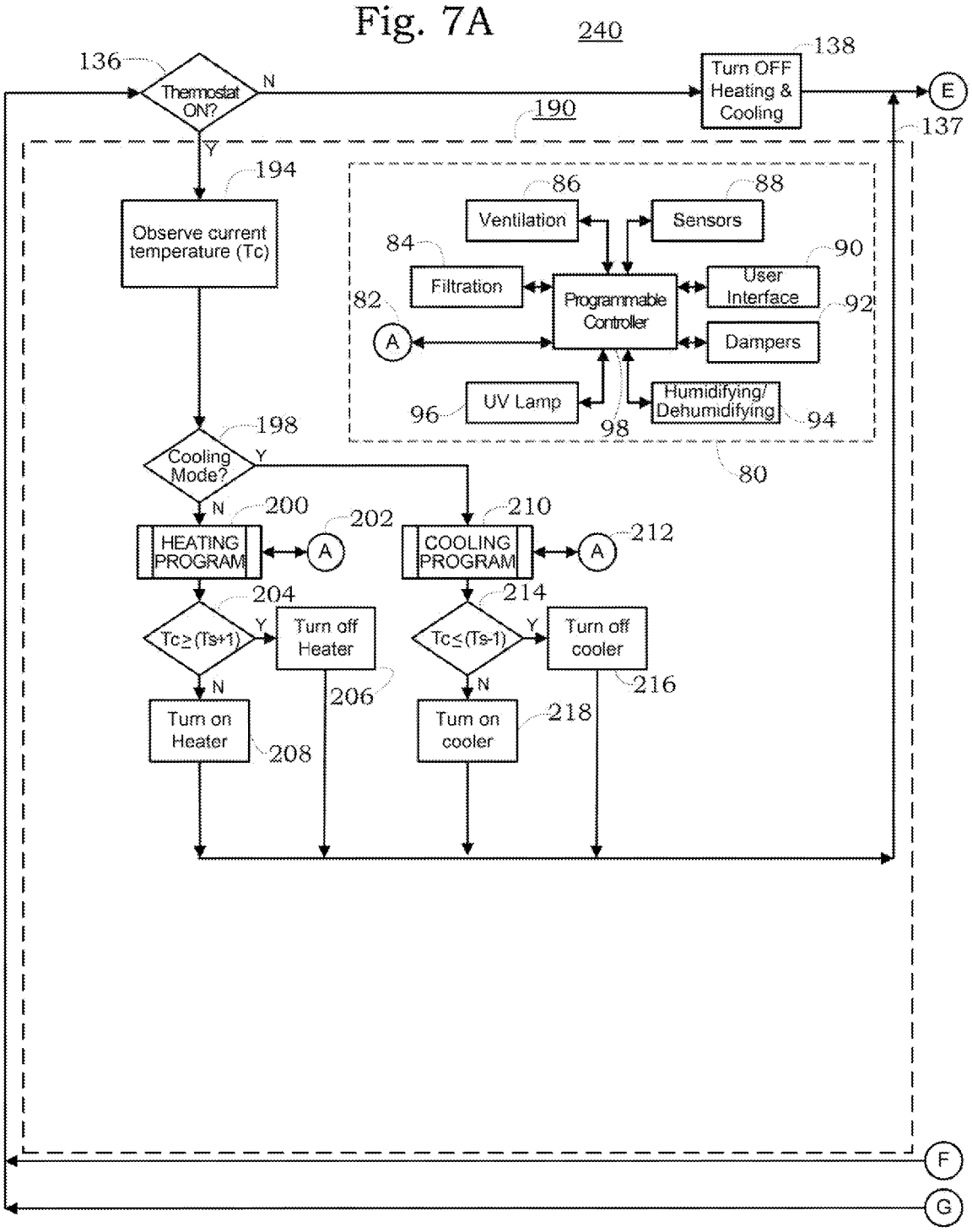
FIG. 7 illustrates a flowchart for operating an automatic mold and fungus growth inhibition device, in accordance with the present invention.
Figure 7B:
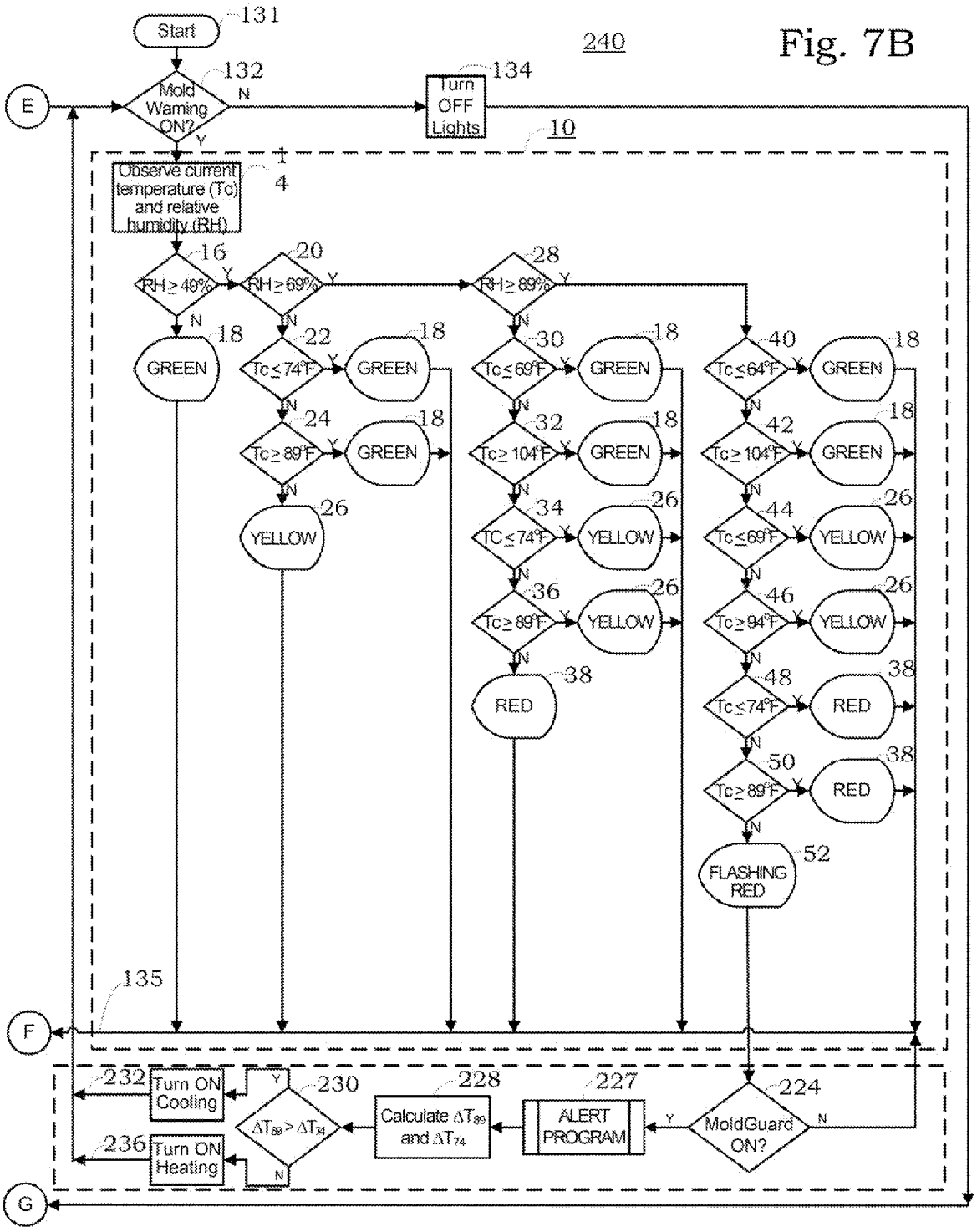

Referring now to FIG. 7 a complete system flowchart to monitor and control temperature, humidity and fungus growth in an efficient manner 240 is shown. Flowchart 240 is entered at block 131 and control is passed to decision step 132. Decision step 132 determines if Mold Warning function 10 is enabled. If Mold Warning function 10 is not enabled, control is passed to block 134 which turns off the warning lights on the device. Control is then passed to decision step 136 which determines if thermostat controller 190 is enabled. If thermostat controller 190 is not enabled, control is passed to block 138 which turns of the heating and cooling system. This loop will continue until either decision step 132 and/or decision step 136 determines that mold warning device 10 or thermostat controller 190 respectively have been enabled.

Consider an example of a current temperature (Tc) of 80° F., a temperature setpoint (Ts) of 72° F. and a relative humidity (RH) of 90%. In this example, Mold Warning device 10 is turned off, MoldGuard device 220 is turned off, and thermostat controller 190 is turned on in cooling mode. The flowchart is entered at block 131. Control is passed to decision step 132 that determines that Mold Warning device 10 is off. Control is passed to block 134 and the Mold Warning lights are turned off. Control then passes to decision step 136 which determines that thermostat controller device 190 is turned on. Control then passes to block 194 and current temperature is found to be 80° F. (Tc=80° F.). Control passes to decision block 198 which determines that the cooling mode is on. Control passes to cooling program 210 which may also activate various devices in heating/cooling subroutine 80. Control passes to decision step 214 which determines that current temperature (Tc=80° F.) is not less than temperature setpoint minus 1 (Ts−1=72° F.−1=71° F.). Control passes to block 218 which activates an air conditioner. Control passes to decision step 132 which again determines that Mold Warning device 10 is inactive. Control will continue through this cooling loop with the air conditioner active until decision step 214 finds that current temperature (Tc) is less than temperature setpoint (Ts) minus 1 (71° F.). When this does occur, meaning the environment temperature is roughly equivalent to the desired temperature, control passes to block 216 which turns off the air conditioner. Control then loops again until current temperature (Tc) is not roughly equivalent to the desired temperature (Ts). At this point the air conditioner will turn on again.

Consider the previous example, having Mold Warning device 10 active. Current temperature (Tc) is 80° F., temperature setpoint is 72° F., and relative humidity is 90%. Mold Warning device 10 is turned on, MoldGuard device 220 is turned off, and thermostat controller 190 is turned on in cooling mode. The flowchart is entered at block 131.

Control is passed to decision step 132 that determines that Mold Warning device 10 is on. Control is passed to block 114 and current temperature (Tc) and relative humidity (RH) are observed to be 80° F. and 90% respectively. Control passes to decision step 16 which determines that relative humidity (RH=90%) is greater than 49%. Control passes to decision step 20 which determines that relative humidity (RH=90%) is greater than 69%. Control passes to decision step 28 which determines that relative humidity (RH=90%) is greater than 89%. Control then passes to decision step 40 which determines that current temperature (Tc=80° F.) is not less than 64° F. Control passes to decision step 42 which determines that current temperature (Tc=80° F.) is not greater than 104° F. Control then passes to decision step 44 which determines that current temperature (Tc=80° F.) is not less than 69° F. Control then passes to decision step 46 which determines that current temperature (Tc=80° F.) is not greater than 94° F. Control then passes to decision step 48 which determines that current temperature (Tc=80° F.) is not less than 74° F. Control then passes to decision step 50 which determines that current temperature (Tc=80° F.) is not greater than 89° F. Flashing red light 52 is illuminated which indicates a high risk of mold infestation and growth.

Control passes to decision step 224 which determines that MoldGuard device 220 is turned off. Control then passes to decision step 136 which determines that thermostat controller device 190 is turned on. Control then passes to block 194 and current temperature is found to be 80° F. (Tc=80° F.). Control passes to decision block 198 which determines that the cooling mode is on. Control passes to cooling program 210 which may also activate various devices in heating/cooling subroutine 80.

Control passes to decision step 214 which determines that current temperature (Tc=80° F.) is not less than temperature setpoint minus 1 (Ts−1=72° F.−1=71° F.). Control passes to block 218 which activates an air conditioner. Control passes to decision step 132 which again determines that Mold Warning device 10 is active. Control again passes through block 14 and decision steps 16, 20, 28, 40, 42, 44, 46, 48, and 50, which results in the continuation of flashing red light 52. Control will continue through this cooling loop with the air conditioner active until decision step 214 finds that current temperature (Tc) is less than temperature setpoint (Ts) minus 1.

When this occurs, meaning the environment temperature is roughly equivalent to the desired temperature, control passes to block 216 which turns off the air conditioner. Control then loops again until current temperature (Tc) is not roughly equivalent to the desired temperature (Ts). At this point the air conditioner will turn on again. Note however that during the time that the air conditioner is active, flashing red light 52 may turn to red light 38, yellow light 26 or green light 18, depending on how much humidity is removed from the air by the cooling system. It is also possible that temperature setpoint (Ts) might be achieved but humidity may remain unacceptably high. In this case the air conditioner would turn off, but red light 52 would remain flashing to indicate a high risk of mold growth.

Consider again the previous example, except having MoldGuard device 220 active. Current temperature (Tc) is 80° F., temperature setpoint is 72° F., and relative humidity is 90%. Mold Warning device 10 is turned on, MoldGuard device 220 is turned on, and thermostat controller 190 is turned on in cooling mode. The flowchart is entered at block 131. Control is passed to decision step 132 that determines that Mold Warning device 10 is on. Control is passed to block 114 and current temperature (Tc) and relative humidity (RH) are observed to be 80° F. and 90% respectively. Control passes to decision step 16 which determines that relative humidity (RH=90%) is greater than 49%. Control passes to decision step 20 which determines that relative humidity (RH=90%) is greater than 69%. Control passes to decision step 28 which determines that relative humidity (RH=90%) is greater than 89%. Control then passes to decision step 40 which determines that current temperature (Tc=80° F.) is not less than 64° F. Control passes to decision step 42 which determines that current temperature (Tc=80° F.) is not greater than 104° F. Control then passes to decision step 44 which determines that current temperature (Tc=80° F.) is not less than 69° F. Control then passes to decision step 46 which determines that current temperature (Tc=80° F.) is not greater than 94° F. Control then passes to decision step 48 which determines that current temperature (Tc=80° F.) is not less than 74° F. Control then passes to decision step 50 which determines that current temperature (Tc=80° F.) is not greater than 89° F. Flashing red light 52 is illuminated which indicates a high risk of mold infestation and growth. Control passes to decision step 224 which determines that MoldGuard device 220 is turned on. Control then passes to alert program 227 which notifies the appropriate person or organization. Control then passes to block 228 which determines that $\Delta T_{89}$ is 9 and $\Delta T_{74}$ is 6. Control is passed to decision step 230 which determines that $\Delta T_{89}$ is greater than $\Delta T_{74}$ (9>6). Control is passed to block 232 which activates the air conditioning system. The purpose of steps 228 and 230 is to determine if it is more efficient to raise the temperature or lower the temperature to get out of the flashing red temperature/humidity growth warning zone. In this example, assuming constant relative humidity, less energy is consumed to cool the environmental temperature by 6° F. than to heat the environmental temperature by 9° F. Control is then passed to decision step 132 which again determines that Mold Growth Warning device 10 is enabled. This loop will continue until the environmental temperature cools and/or dehumidifies so that flashing red light 52 is no longer illuminated, and temperature will be controlled again by thermostat controller 190.

Referring to FIG. 4, the various components of a duct type air conditioning system for a multi-zone residence are shown together with their thermostat controllers which are adapted to operate in accordance with the present invention. A plurality of zones in which the temperature is to be controlled are schematically illustrated as a space or room designated by numeral 144, 146, 148, and defined by walls, floors, ceilings, and the like with a supply air register vent 178, 180, 182, or other device, provided for supplying conditioned air to each zone. A supply duct system 181 is connected to each register vent and includes a segment of branch duct to control the flow of conditioned air into each space or zone. A control/sensor unit of the present invention 166, 168, 170 is mounted on suitable surfaces, such as a wall surface, or the like, in the respective zones which modulate dampers 184, 186, 188 in the supply duct 181 thereby controlling the inflow of conditioned air into the respective zones 144, 146, 148. Dampers 184, 186, and 188 are normally constructed with a control box mounted externally of the duct to receive a control signal from controller 150 in order to pivot the damper blades, about a central shaft which extends diametrically into each register vent 178, 180, 182. In this manner the control box can modulate the damper blades between open and closed positions. Return intake ducts 172, 174, 176 return air from the conditioned spaces to the main HVAC heating/cooling unit 152.

In an example of operation of the present invention, assume that the homeowners are away from the house during a thunderstorm and the HVAC system is active along with mold growth warning device 10 and MoldGuard device 220. During the storm, a window breaks in first zone 144, allowing hot (88° F.), humid (95%) air into the room. Control/sensor unit 166 will determine that this combination of temperature and humidity are within the established criteria which indicate a high risk of mold growth. Flashing red light 52 is illuminated. MoldGuard alert program 227 may send a signal to the homeowners, security monitoring agency or other such organization to investigate the problem. Moldguard decision step 230 determines that $\Delta T_{89}$=1 and $\Delta T_{74}$=14. Therefore, less energy will be consumed by heating the room to diminish the threat of mold growth than by cooling the room. Controller 150 sends signals to open first zone damper 184 and close second and third dampers 186 and 188. Controller 150 sends another signal to air routing valve 158 to route air for heating. Controller 150 sends other signals to main HVAC unit 152 to activate heating system 162 and fan 156. Heated air is then routed to first zone 144 to increase the local air temperature and simultaneously reduce the humidity level.

Conclusion, Ramifications, and Scope

Accordingly, there is provided a device that will control an enclosed environment to minimize mold and fungus growth in an energy efficient manner.

While the present invention has been described in detail with reference to the illustrative embodiment, these should not be construed as limitations on the scope of any embodiment, but as exemplifications of the presently preferred embodiments thereof. Many other ramification, modifications and variations would present themselves to those skilled in the art without parting from the true spirit and scope of the invention. Thus the true scope of the invention should be determined by the appended claims and their legal equivalents, and not limited to the examples provided.

Drawing Reference Numerals

FIG. 1 Prior Art
10 Mold Warning Flowchart
12 start
14 observation step
16 humidity decision step
18 illuminate green
20 humidity decision step
22 temperature decision step
24 temperature decision step
26 illuminate yellow
28 humidity decision step
30 temperature decision step
32 temperature decision step
34 temperature decision step
36 temperature decision step
38 illuminate yellow
40 temperature decision step
42 temperature decision step
44 temperature decision step
46 temperature decision step
48 temperature decision step
50 temperature decision step
52 illuminate flashing red
FIG. 2 Prior Art
60 Thermostat and Humidity Controller Flowchart
62 start
64 observation step
66 observation step
68 cooling mode decision step
70 heating program subroutine
72 heating program subroutine interface
74 temperature decision step
76 turn off heater
78 turn on heater
80 Heating/Cooling Subroutine
82 heating/cooling subroutine interface
84 filtration process
86 ventilation process
88 sensors
90 user interface
92 damper control process
94 humidifying/dehumidifying process
96 ultraviolet lamp process
98 heating/cooling subroutine controller
100 cooling program subroutine
102 cooling program subroutine interface
104 temperature decision step
106 turn off cooling
108 turn on cooling
110 humidity decision step
112 do not adjust on time
114 adjust on time
116 observe humidity step
118 humidity decision step
120 do not reset on time
122 reset on time
FIG. 3 Prior Art
130 Combination Thermostat and Humidity Controller with Mold Growth Warning Flowchart
131 start
132 mold growth warning on decision step
134 turn off mold growth warning lights
135 control exits mold growth warning device
136 thermostat on decision step
137 control exits thermostat and humidity controller
138 turn off heating and cooling
FIG. 4
140 Schematic View of an HVAC System
142 inside space
144 first zone
146 second zone
148 third zone
150 controller
152 main HVAC unit
154 air filter
156 fan or blower
158 air routing valve
160 cooling unit
162 heating unit
164 external air conditioning unit
166 first zone thermostat/humidistat
168 second zone thermostat/humidistat
170 third zone thermostat/humidistat
172 first zone air intake
174 second zone air intake
176 third zone air intake
178 first zone vent
180 second zone vent
182 third zone vent
184 first zone damper
186 second zone damper
188 third zone damper
FIG. 5
190 Thermostat Controller Flowchart
192 start
194 observation step
198 cooling mode decision step
200 heating program subroutine
202 heating program subroutine interface
204 temperature decision step
206 turn off heater
208 turn on heater
80 Heating/Cooling Subroutine
82 heating/cooling subroutine interface
84 filtration process
86 ventilation process
88 sensors
90 user interface
92 damper control process
94 humidifying/dehumidifying process
96 ultraviolet lamp process
98 heating/cooling subroutine controller
210 cooling program subroutine
212 cooling program subroutine interface
214 temperature decision step
216 turn off cooling
218 turn on cooling
FIG. 6
220 MoldGuard Flowchart
222 start
224 MoldGuard enabled decision step
226 back to main flowchart
227 Alert program
228 calculate DT process
230 ΔT decision step
232 turn on cooling
234 back to main flowchart
236 turn on heating
238 back to main flowchart

FIG. 7

240 Thermostat Controller with Mold Guard Flowchart

What is claimed is:

1. An apparatus for automatically controlling environmental conditions, comprising:

an enclosed structure having at least two zones for automatic environmental condition control;

a heating, ventilation and air conditioning (HVAC) system incorporated into the structure, wherein each zone includes separate controls, wherein air flow into and out of each zone is separately controlled, with a separate intake, vent, damper, thermostat and humidistat for each zone, wherein temperature and humidity are each separately controllable for each zone;

a controller in communication with the HVAC system for controlling the HVAC system and for controlling the damper for each zone, the controller having a MoldGuard function and a map comprising a plurality of relative humidity and temperature combinations and one or more actions for automatic execution based on the combinations of temperature and humidity;

a temperature sensor in each zone attached to the controller, for determining a current temperature in each zone;

a relative humidity sensor in each zone attached to the controller; and an indicator array/interface panel attached to the controller, wherein the HVAC system determines if the MoldGuard function is enabled, determines a first temperature difference between the current temperature and 89° F. ($\Delta T_{89}$), determines a second temperature difference between the current temperature and 74° F. ($\Delta T_{74}$), determines if the first temperature difference ($\Delta T_{89}$) is greater than the second temperature difference ($\Delta T_{74}$), wherein when the first temperature difference ($\Delta T_{89}$) is greater than the second temperature difference ($\Delta T_{74}$), turning on a cooling system; and when the first temperature difference ($\Delta T_{89}$) is not greater than the second temperature difference ($\Delta T_{74}$), turning on a heating system, wherein the apparatus provides for the automatic elimination of environmental conditions favorable to mold and fungus growth for each zone individually.

2. The apparatus for automatically controlling environmental conditions according to claim 1, wherein the controller comprises a microprocessor.

3. The apparatus for automatically controlling environmental conditions according to claim 1, wherein the HVAC system comprises a HVAC unit which includes an air filter;

a blower unit;

an air routing valve;

a cooling unit; and a heating unit.

4. The apparatus for automatically controlling environmental conditions according to claim 3, further comprising a plurality of HVAC units.

5. A method for automatically controlling environmental conditions in an enclosed structure having at least two zones for automatic environmental condition control;

a heating, ventilation and air conditioning (HVAC) system incorporated into the structure, wherein each zone includes separate controls, wherein air flow into and out of each zone is separately controlled, with a separate intake, vent, damper, thermostat and humidistat for each zone, wherein temperature and humidity are each separately controllable for each zone;

a controller in communication with the HVAC system for controlling the HVAC system and for controlling the damper for each zone, the controller having a map comprising a plurality of relative humidity and temperature combinations and one or more actions for automatic execution based on the combinations of temperature and humidity;

a temperature sensor in each zone attached to the controller;

a relative humidity sensor in each zone attached to the controller; and an indicator array/interface panel attached to the controller, comprising the steps of:

(a) selecting a temperature setpoint in each zone with a thermostat;

(b) selecting a desired relative humidity level in each zone with a humidistat;

(c) observing a current temperature in each zone;

(d) observing a current relative humidity level in each zone;

(e) maintaining each zone at the selected temperature setpoint and relative humidity setpoint corresponding to each zone;

(e1) determining if a MoldGuard function is enabled;

(e2) determining a first temperature difference between the current temperature and 89° F. ($\Delta T_{89}$);

(e3) determining a second temperature difference between the current temperature and 74° F. ($\Delta T_{74}$);

(e4) determines if the first temperature difference ($\Delta T_{89}$) is greater than the second temperature difference ($\Delta T_{74}$);

(e5) when the first temperature difference ($\Delta T_{89}$) is greater than the second temperature difference ($\Delta T_{74}$), turning on a cooling system; and (e6) when the first temperature difference ($\Delta T_{89}$) is not greater than the second temperature difference ($\Delta_{74}$), turning on a heating system, wherein the method provides for the automatic elimination of environmental conditions favorable to mold and fungus growth for each zone individually.

6. The method for automatically controlling environmental conditions in an enclosed structure according to claim 5, step (e) further comprising the steps:

(e7) determining if the HVAC system for each zone is in a cooling mode or a heating mode;

(e8) when the HVAC system is in the heating mode, determining if the current temperature is greater than or equal to the temperature setpoint plus one degree in a particular zone; and (e9) when the current temperature in the particular zone is greater than or equal to the current temperature plus one degree, turning off a heater portion of the HVAC system corresponding to the particular zone.

7. The method for automatically controlling environmental conditions in an enclosed structure according to claim 5, step (e) further comprising the steps:

(e7) determining if the HVAC system for each zone is in a cooling mode or a heating mode;

(e8) when the HVAC system is in the cooling mode, determining if the current temperature is not greater than or equal to the temperature setpoint plus one degree in a particular zone; and (e9) when the current temperature in the particular zone is not greater than or equal to the current temperature plus one degree, turning on a heater portion of the HVAC system corresponding to that particular zone.

8. The method for automatically controlling environmental conditions in an enclosed structure according to claim 5, step (e) further comprising the steps:

(e7) determining if the HVAC system for each zone is in a cooling mode or a heating mode;

(e8) when the HVAC system is in the cooling mode, determining if the current temperature is less than or equal to the temperature setpoint minus one degree for a particular zone; and (e9) when the current temperature is less than or equal to the current temperature minus one degree, turning off a cooling system portion of the HVAC system for the particular zone.

9. The method for automatically controlling environmental conditions in an enclosed structure according to claim 5, step (e) further comprising the steps:

(e7) determining if the HVAC system for each zone is in a cooling mode or a heating mode;

(e8) when the HVAC system is in the cooling mode, determining if the current temperature is less than or equal to the temperature setpoint minus one degree for a particular zone; and (e9) when the current temperature is not less than or equal to the current temperature minus one degree, turning on a cooling system portion of the HVAC system.

10. The method for automatically controlling environmental conditions in an enclosed structure according to claim 5, step (e1) further comprising the steps:

(i) when the MoldGuard function is enabled, activating an alert program to provide notice of an active MoldGuard function;

(ii) comparing the relative efficiency between raising and lowering the temperature setpoint to determine a most efficient option for combating mold and fungus growth; and (iii) overriding the temperature setpoint.

* * * * *